US006131798A

United States Patent [19]

Prengaman

[11] Patent Number: 6,131,798

[45] Date of Patent: Oct. 17, 2000

[54] ELECTROWINNING ANODE

[75] Inventor: R. David Prengaman, Arlington, Tex.

[73] Assignee: RSR Technologies, Inc., Dallas, Tex.

[21] Appl. No.: 09/221,082

[22] Filed: Dec. 28, 1998

[51] Int. Cl.[7] ..... B23K 31/00

[52] U.S. Cl. ..... 228/139; 228/135; 228/178; 228/176; 228/199

[58] Field of Search ..... 228/139, 135, 228/178, 176, 199; 29/825, 428, 460

[56] References Cited

U.S. PATENT DOCUMENTS

| | | | |
|---|---|---|---|
| 3,947,344 | 3/1976 | Golikov et al. | 204/286 |
| 3,957,600 | 5/1976 | Ives et al. | 204/105 R |
| 4,121,994 | 10/1978 | Crippen et al. | 204/286 |
| 4,269,687 | 5/1981 | Gilbert et al. | 204/242 |
| 4,373,654 | 2/1983 | Prengaman et al. | 228/173 R |
| 5,172,850 | 12/1992 | Prengaman et al. | 228/176 |
| 5,464,519 | 11/1995 | Tomba et al. | 204/280 |
| 5,619,793 | 4/1997 | Tomba et al. | 29/879 |
| 5,783,058 | 7/1998 | Fowler et al. | 205/205 |

FOREIGN PATENT DOCUMENTS

| | | | |
|---|---|---|---|
| 414188 A1 | 2/1991 | European Pat. Off. | H05K 7/02 |

*Primary Examiner*—Patrick Ryan
*Assistant Examiner*—M. Alexandra Elve
*Attorney, Agent, or Firm*—Theresa M. Gillis

[57] ABSTRACT

In an electrowinning anode in which a lead anode sheet is tightly fitted to a copper busbar, the anode sheet is additionally joined to the busbar by pinning to prevent damage to the joint. A lead coating is electrodeposited onto the busbar, pin and the soldered joint to provide a complete metallurgical seal and good resistance to acid corrosion.

7 Claims, 4 Drawing Sheets

5,172,850

ELECTROWINNING ANODE

BACKGROUND OF THE INVENTION

A. Field of Invention

This invention relates to an improved electrowinning anode and its method of manufacture. The anode is a lead alloy sheet joined to a copper busbar. A pin is inserted through the joint between the sheet and the busbar and a layer of lead is electrodeposited over the busbar, pin, and the joint between the busbar and the anode sheet.

B. State of the Art

Lead alloys have been used for many years as electrowinning anodes for the recovery of copper, nickel, and zinc from sulfate solutions. For most uses, the anode is produced by casting lead into a mold to produce the anode size and shape. The lead or lead alloy flows around a copper busbar to provide electrical contact between the anode sheet and the copper busbar. The lead may also serve as a protective barrier to prevent attack of the copper busbar from acid mist or direct electrolyte impingement.

Rolled lead alloy sheet for anodes offers advantages of reduced porosity, more uniform cross section, more uniform grain structure, and reduced corrosion rates than cast anodes. The rolled lead alloy sheet, however, must be joined to the copper busbar as shown in FIG. 1. In most cases the lead anode sheet (1) is joined to the copper busbar (2) by first casting lead around the busbar (3) as shown in FIG. 1 and subsequently welding or burning the rolled sheet to the lead cast around the busbar. The lead cast around the busbar may be the same composition as the anode sheet or a different alloy may be used to cast around the busbar prior to attachment of the sheet by welding or burning.

A new method to attach the rolled lead alloy sheet to a copper busbar was developed in U.S. Pat. No. 4,373,654. In this system a rolled lead-calcium-tin alloy sheet is joined to a copper busbar by means of a solder joint in a slot in the busbar. This method gives a complete metallurgical bond between the sheet and bar unlike that attained in the cast around the bar system. A thin coating of lead-tin alloy was formed on the bar by dipping prior to the soldering process to protect the copper busbar from acid mist or direct impingement of electrolyte. However, this did not completely protect the busbar, and in use some attack of the copper busbar occurred. Eventually the solder joint was exposed and attacked.

The attack on the busbar was prevented by an improvement developed in U.S. Patent No. 5,172,850. As shown in FIG. 2, in this improvement the rolled lead alloy sheet (4) is joined to the copper busbar (5) by means of a soldered joint (6) in slot (7) of the busbar. A thin coating of lead tin alloy (8) is formed on the surface of the copper busbar by dipping prior to the soldering process. The soldered joint is sealed by puddling a filler alloy (9) into all crevices. A coating of lead (10) is electrodeposited onto the surface of the busbar and over the joint between the busbar and the anode sheet to give a complete metallurgical seal around the busbar and joint. The finished anode of this method provides excellent resistance to attack by the acid mist or direct impingement of electrolyte onto the busbar area.

A lead anode sheet soldered into the slot of a copper busbar and subsequently coated with a layer of electrodeposited lead onto the busbar and over the joint between the busbar and the anode sheet produces an anode with a complete metallurgical bond between anode sheet and busbar as well as a complete seal around the busbar and joint.

This method of producing electrowinning anodes has been proved to produce low resistance between busbar and anode sheet while protecting the busbar and joint from attack from acid mists or direct impingement of electrolyte onto the bar and soldered joint.

In some cases premature failure of the anodes has occurred by damage to the soldered joint at the edge of the sheet. This damage is caused by dropping the anode from some distance such that the busbar contacts the side of the cell and is bent upward. This deformation of the busbar can cause delamination of the bar from the anode sheet at one end of the soldered joint. Breaking of the solder bond can provide entry of electrolyte into the joint causing corrosion of the busbar/anode sheet interface.

The anode may be accidentally lifted and subsequently dropped during pulling of the cathodes when the crane accidentally picks up an anode as well as the cathode. Since the hook is not long enough to hold the anode, it falls back into the tank as the cathodes are lifted from the cell. Other incidents such as short circuits where dendrites grow from the copper cathode and attach themselves to the anode result in raising the anode part way out of the cell during pulling the cathode. When the bond between anode and cathode is broken due to the weight of the anode, the anode falls back into the cell.

The anode may also be damaged when the anodes are removed from the cell to remove adhering deposits or flakes or to clean the sludge from the cell. In such cases the anodes are removed from the cell by a crane and placed on racks. Depending on the experience of the crane operator the anodes may be dropped onto the racks. The anodes may also be handled mechanically such as to remove the $PbO_2/MnO_2$ anode deposit as in zinc electrowinning. Such handling may include dropping the anode which may damage the edge of the soldered joint. The force of the falling anode contacting the side of the cell can result in bending of the busbar. When the busbar is bent most of the force is transmitted to the edge of the busbar/anode sheet interface because this interface is more rigid than the busbar alone. If the force is sufficient, the busbar may be peeled away from the anode sheet at the end of the solder joint.

The present invention provides a method of protecting the busbar/anode sheet soldered joint from damage due to mishandling.

SUMMARY OF TEE INVENTION

The present invention provides an improved electrowinning anode of the type having a lead anode sheet soldered into a copper busbar. The improvement comprises pinning the anode sheet to the copper busbar to prevent damage to the solder joint if the anode is dropped or mishandled. The surface of the busbar, the pin, and the joint between the busbar and the anode sheet are coated with a layer of lead via electrodeposition to provide a complete metallurgical seal around the busbar and the joint.

DESCRIPTION OF TEE DRAWINGS

FIG. 1 is a side view of a prior art anode. FIG. 2 is a side view of the preferred embodiment of the anode described in U.S. Pat. No. 5,172,850. FIG. 3 is a side view of the preferred embodiment of the anode of the present invention. FIG. 4 is a front view of the anode of the invention.

DETAILED DESCRIPTION OF THE INVENTION

In the practice of the present invention, a lead anode sheet (1) is joined to a copper busbar (12) in a manner which permits good conductivity between the busbar and the lead alloy sheet. FIGS. 3 and 4 show the preferred manner of joining the busbar and anode sheet. As shown in FIG. 3, the lead alloy sheet is tightly fitted into a longitudinal slot (13) of a copper busbar. Optimally, the sheet is joined to the busbar using solder (14) to fill the slot, and the soldered joint is sealed by puddling a filler alloy (16) into all crevices. The joint between the busbar and anode sheet is strengthened to prevent damage during handling by one or more pins (17) inserted through the joint between the busbar and lead alloy sheet. The busbar, pins, and the joint are covered by a coating of lead (18) by means of electrodeposition thus forming an anode which is substantially corrosion resistant with improved structural integrity.

Insertion of a pin or rivet completely through the copper busbar and the lead alloy 9 sheet in the soldered joint area prevents damage to the edge of the soldered joint when the anodes are dropped or mishandled. Preferably, the pin is placed as near as practical to the edge of the soldered joint so that it can support some of the shear stress applied to the soldered joint if the anode is dropped or mishandled. The pin may be driven through the joint by force or a hole may be drilled through the busbar/anode sheet joint and a pin inserted. The pin or rivet may extend beyond the surface of the copper busbar. The pin, as well as the copper busbar and the joint between the busbar and the anode sheet, is covered by an electrodeposited layer of lead to provide a metallurgical seal over the busbar and joint.

In accordance with the invention, lead alloy anode material used in electrowinning is formed as a sheet. The lead sheet material employed in the anodes of the invention may be any lead alloy suitable for use in electrowinning. Examples of such alloys include lead-silver, lead-calcium-silver, lead-calcium-barium-silver, lead-antimony, lead-antimony-arsenic, lead-calcium, lead-strontium-tin, lead-calcium-barium-tin, lead-calcium-strontium-tin and lead-calcium-tin alloys. The sheet may be formed by casting, extruding or rolling the alloy material. References to lead anode material herein are intended to include all lead alloys, however formed, which are suitable as anode material in electrowinning from sulfuric acid electrolytes.

The copper busbar may be dipped wholly or partially into an alloy of lead and tin to produce a substrate (15) for electrodeposition. For example, a lead alloy containing a sufficient amount of additional tin component which bonds to the copper bar will be an effective coating material. A preferred coating material is a lead-tin-antimony alloy containing at least 50% lead.

The anode sheet (11) may be joined to a busbar (12) as taught in U.S. Pat. No. 4,373,654, the disclosures of which are incorporated herein by reference. However, any joinder means which does not require widening the anode to any significant extent beyond the width of the busbar and which permits good conductivity between the lead sheet and the busbar may be used.

In preferred practice shown in FIG. 3, the busbar (12) has a longitudinal slot (13) into which the lead sheet fits snugly. The bar and the lead sheet are joined together preferably by means of a solder material (14). The solder is preferably a material containing tin and other materials and having a low melting point and sufficient fluidity to allow penetration into the slot and bonding between the copper bar and the lead alloy sheet. Such penetration and bonding maximizes the contact between the bar and anode sheet, thus optimizing conductivity. A thin coating of a lead-tin alloy (15) is formed on the surface of the busbar by dipping prior to the soldering process. The final burning operation is performed by puddling a filler alloy (16) into all crevices. The filler alloy should bond to the solder, to the copper bar or bar coating alloy and to the anode sheet. It should fill all crevices and create a smooth transition joint between bar and sheet. Preferred filler alloys are: the bar coating alloy, a lead-antimony alloy, as for example lead-antimony alloy, a lead-low tin solder, a lead-copper alloy, or a lead-silver alloy.

The joint between the anode sheet and the copper busbar is strengthened to prevent damage to the joint by inserting a pin (17) through the busbar, joint, and the lead alloy sheet. This pin prevents damage to the soldered joint by resisting high stresses exerted on the soldered joint by deformation of the busbar caused by misuse or dropping of the anode. Preferably two pins are inserted near either end of the joint as shown in FIG. 4.

The pin may be inserted as a rivet forced through the busbar or by a pin inserted into a hole drilled through the busbar, solder joint, anode sheet interface. The pin may be copper, brass, bronze, stainless steel, or other material sufficiently strong to resist deformation induced by dropping the anode.

In the practice of the present invention, a coating of lead (18) is electrodeposited onto the outside surface of the coated busbar and over the joint. The coating need only be thick enough to ensure complete coverage of the bar, pin and the joint with a corrosion resistant layer.

Electrodeposition may be effected by simply inverting the joined anode sheet and busbar and immersing the anode into an electroplating solution until the busbar, pin and the joint are completely covered by the solution. The anode is then electrically connected in a manner such that the anode functions as a cathode. The anode used in the electroplating process is any suitable lead material from which lead can be dissolved and deposited on the copper busbar "cathode." Pure lead anodes are preferred, but various lead alloys may also be used. A suitable current is then applied for a period of time sufficient to produce the desired coating.

The bath may consist of a solution of lead fluoborate, lead sulfamate, lead fluorosilicate, or other plating bath from which lead can be electrodeposited on the surface of the busbar. In this process, metal is dissolved from a pure lead or lead alloy anode and electrodeposited onto the coated copper busbar producing a complete metallurgical seal around the busbar by the electrodeposited coating. The thickness of the electrodeposited layer may vary from 0.001" (0.025 mm) to 0.160" (4 mm). The normal range is 0.020" (0.5 mm) to 0.080" (2 mm).

The following example is illustrative of the invention.

EXAMPLE

Anodes were produced by slotting the copper busbar, coating by dipping with a thin (0.002–0.005") layer of lead-15% tin-1% antimony alloy. A rolled lead-calcium-tin alloy sheet was joined to the coated bar by filling the slot with a lead-70% tin alloy and placing the rolled sheet into the slot in the bar. The joint was sealed with lead-6% antimony filler metal.

The ends of the soldered joint were pinned by brass rivets 0.125"D which were driven through the busbar, joint, and sheet via air pressure.

Finished anodes were inverted and immersed in a lead fluoborate plating bath such that the complete copper busbar and some of the rolled lead calcium-tin-alloy sheet was immersed in the electrolyte. The electrical connection was made in such a manner as to make the anode a cathode. Pure lead was used as the anode material. A current of approximately 200 a/m2 was applied for 16 hours resulting in the deposition of about 0.028" (0.77 mm) of lead coating onto the bar.

An anode produced via the described process was raised to a height of three feet above a simulated tankhouse cell and dropped to simulate the misuse conditions which might be experienced in the tankhouse. The anode produced by pinning the ends of the joint suffered a severely deformed busbar but no cracking or delamination of the joint.

An anode produced according to U.S. Pat. No. 5,172,850 was subjected to the same misuse conditions. The busbar was severely deformed and the soldered joint at one end of the anode contained a three inch long crack.

What is claimed is:

1. A method of making an electrowinning anode comprising a. fitting a lead alloy sheet into a slot in a busbar;

b. pinning the busbar to the sheet;

c. electrodepositing a coating of lead onto the busbar, pin and joint to form a metallurgical seal around the busbar, pin and joint between the sheet and busbar.

2. The method of claim 1 comprising a. forming a sheet of lead alloy anode material;

b. forming a copper busbar with a longitudinal slot of such size that an end of the lead alloy sheet fits tightly therein;

c. fitting said end of the lead sheet into said slot of the busbar;

d. soldering the busbar and sheet together;

e. pinning the busbar to the sheet through the joint;

f. immersing the pinned busbar and the soldered joint into a lead electroplating bath, and g. electrodepositing a coating of lead onto the busbar, pin, and joint whereby a metallurgical seal is formed around the busbar, pin and soldered joint.

3. The method of claim 1 wherein the busbar is at least partially coated with a tin alloy before the lead sheet is fitted into the slot of the busbar.

4. The method of claim 1 wherein the sheet is pinned to the ends of the busbar.

5. The method of claim 1 wherein the sheet is pinned to the busbar by a rivet.

6. The method of claim 1 wherein the sheet is pinned to the busbar by a pin.

7. An electrowinning anode comprising a. a sheet of lead alloy material;

b. a copper busbar having a longitudinal slot into which the sheet is tightly fitted;

c. a pin through the joint between the copper busbar and the sheet; and d. a metallurgical seal around the pin, the busbar and the joint between the sheet and the busbar.

* * * * *

US006131798C1

(12) EX PARTE REEXAMINATION CERTIFICATE (9628th)

United States Patent
Prengaman

(10) Number: US 6,131,798 C1
(45) Certificate Issued: May 3, 2013

(54) ELECTROWINNING ANODE

(75) Inventor: R. David Prengaman, Arlington, TX (US)

(73) Assignee: RSR Technologies, Inc., Dallas, TX (US)

Reexamination Request:
No. 90/011,914, Sep. 21, 2011

Reexamination Certificate for:

| | |
|---|---|
| Patent No.: | **6,131,798** |
| Issued: | **Oct. 17, 2000** |
| Appl. No.: | **09/221,082** |
| Filed: | **Dec. 28, 1998** |

(51) Int. Cl.
*C25C 7/02* (2006.01)

(52) U.S. Cl.
USPC ..... 228/139; 228/135; 228/176; 228/178; 228/179; 228/199

(58) Field of Classification Search
None
See application file for complete search history.

(56) References Cited

To view the complete listing of prior art documents cited during the proceeding for Reexamination Control Number 90/011,914, please refer to the USPTO's public Patent Application Information Retrieval (PAIR) system under the Display References tab.

*Primary Examiner* — Timothy Speer

(57) ABSTRACT

In an electrowinning anode in which a lead anode sheet is tightly fitted to a copper busbar, the anode sheet is additionally joined to the busbar by pinning to prevent damage to the joint. A lead coating is electrodeposited onto the busbar, pin and the soldered joint to provide a complete metallurgical seal and good resistance to acid corrosion.

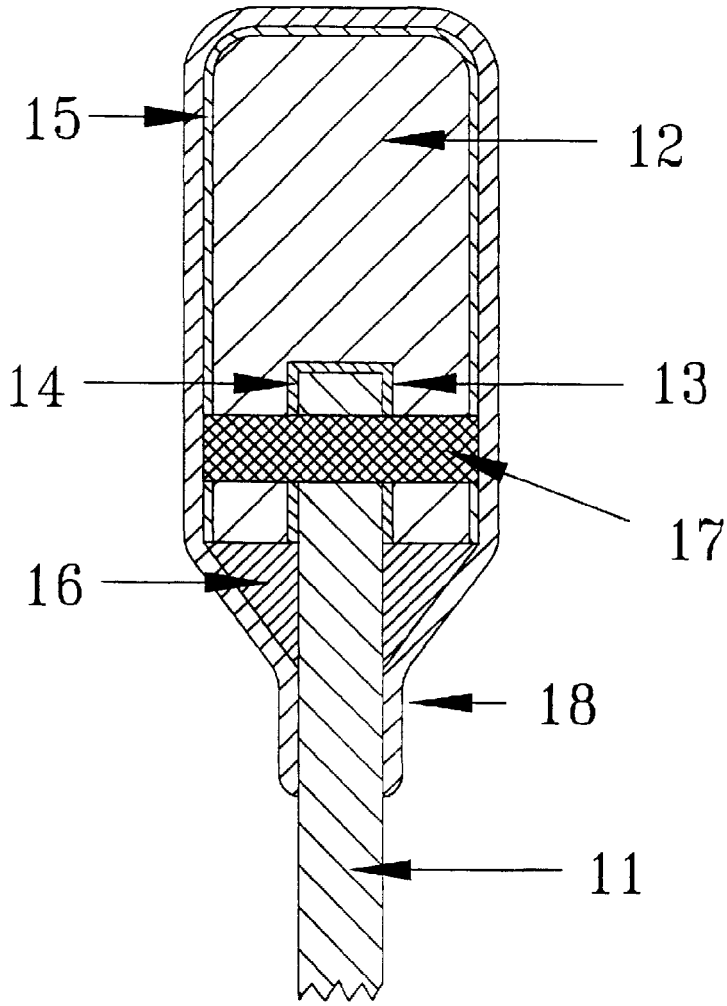

EX PARTE REEXAMINATION CERTIFICATE ISSUED UNDER 35 U.S.C. 307

Figure 1:
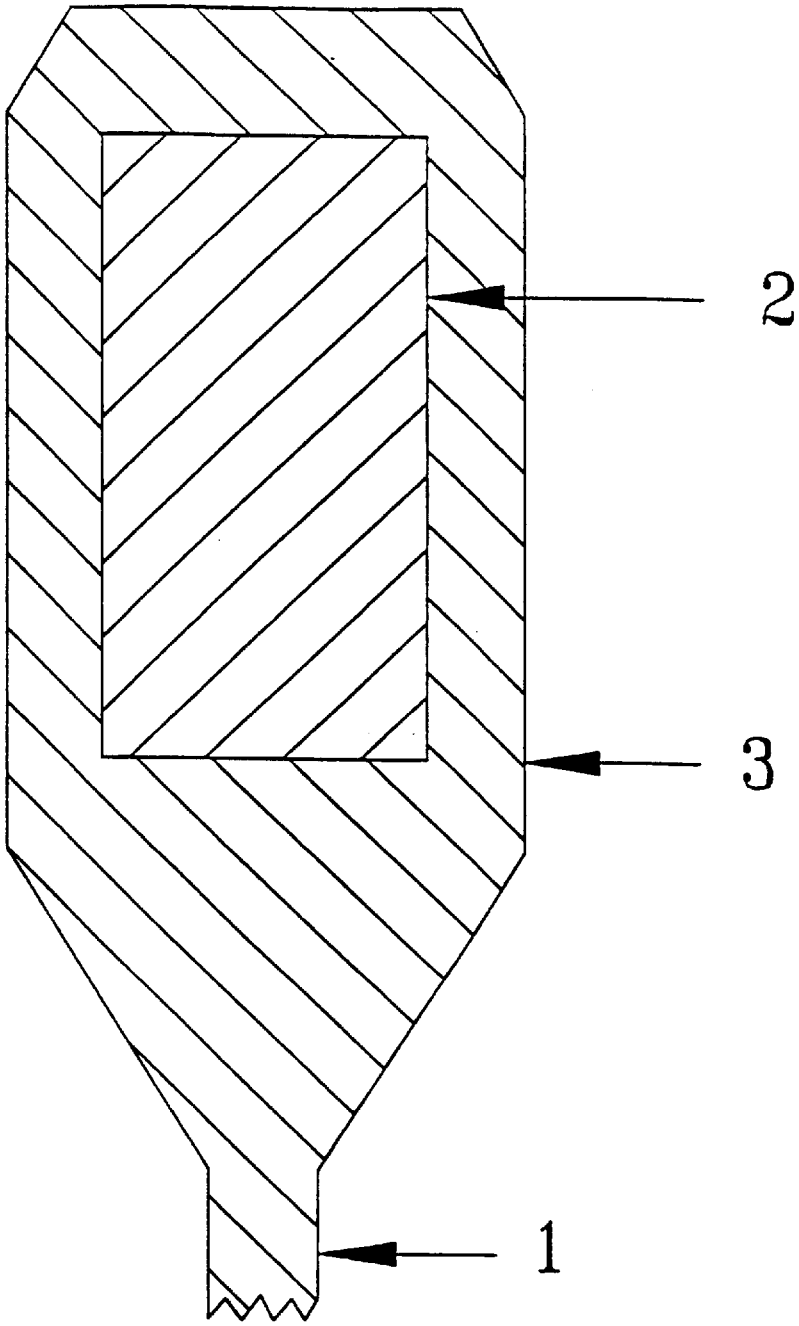
FIG. 1 PRIOR ART
Figure 2:
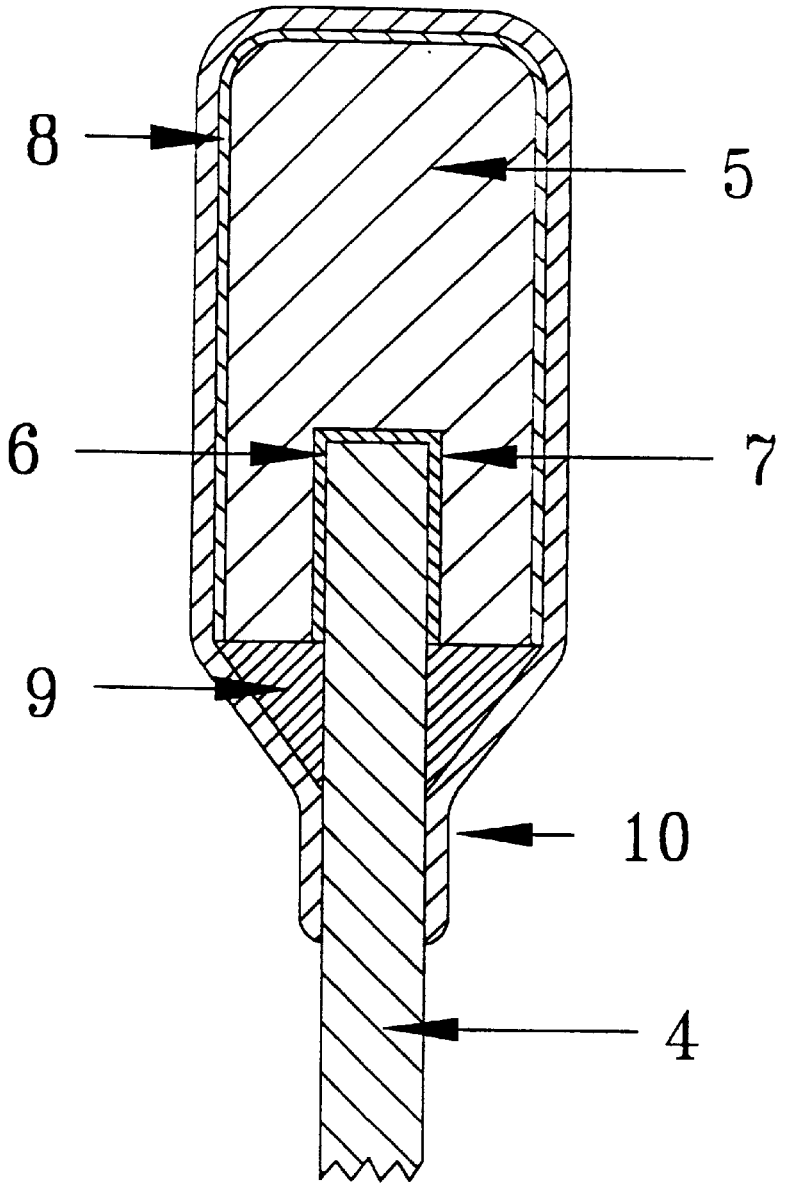
FIG. 2 PRIOR ART
Figure 3:
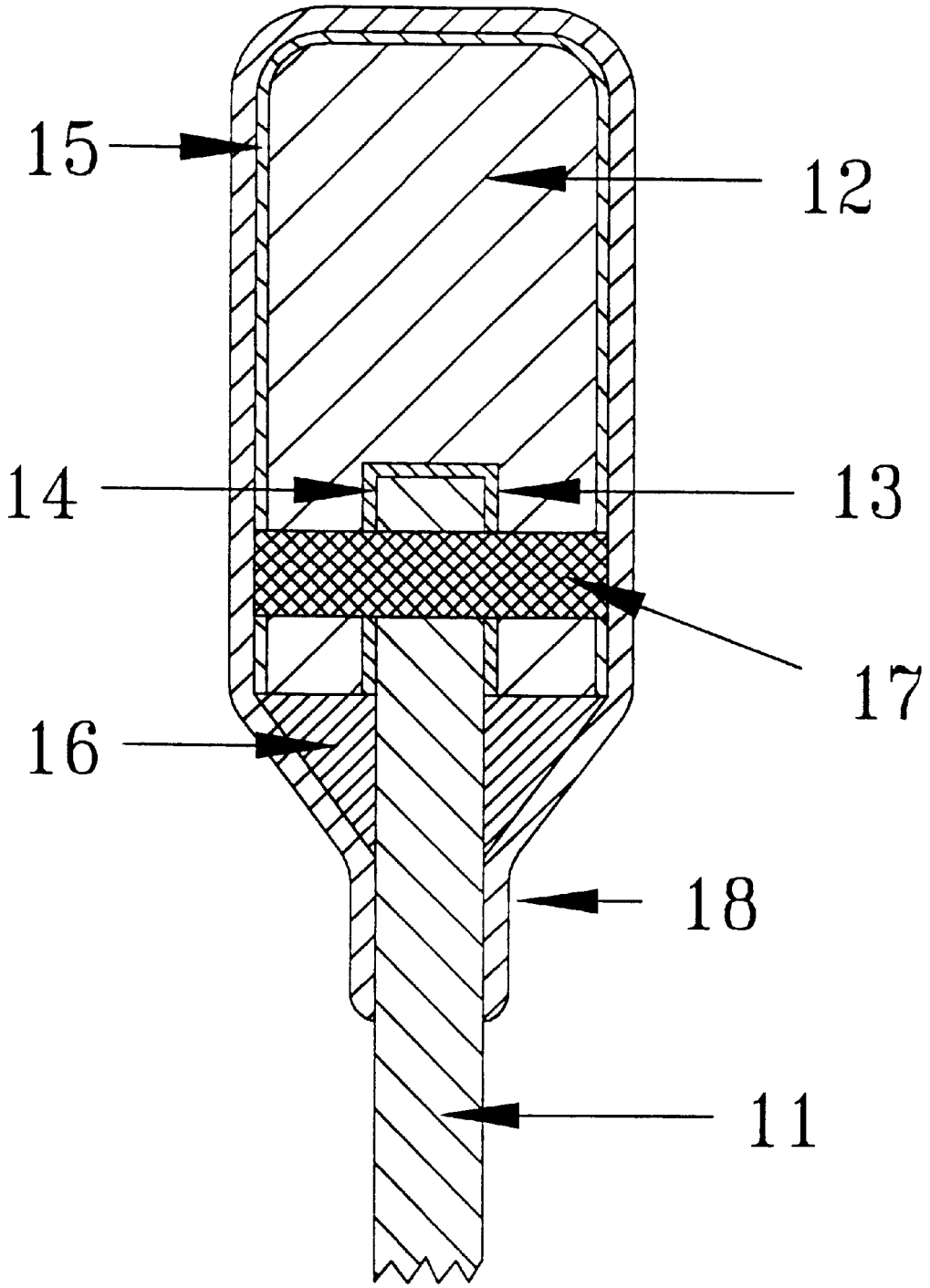
Figure 4:
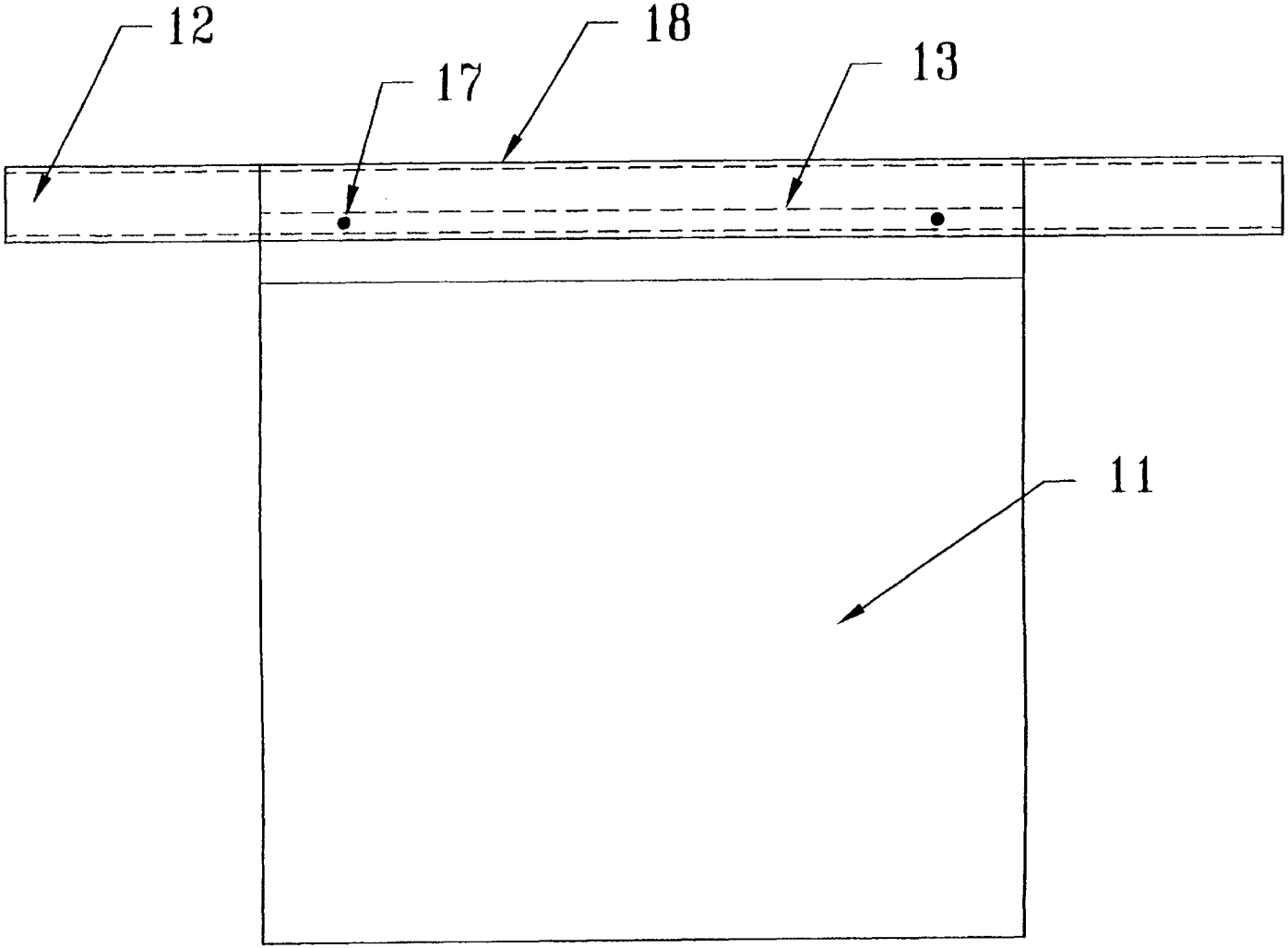

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 2 is confirmed.

Claims 1 and 7 are cancelled.

Claims 3-6 are determined to be patentable as amended.

New claims 8-16 are added and determined to be patentable.

3. The method of claim [1] *2 or 8* wherein the busbar is at least partially coated with a [tin] *lead-tin* alloy before the lead sheet is fitted into the slot of the busbar.

4. The method of [1] *2 or 8* wherein the sheet is pinned to the ends of the busbar.

5. The method of [1] *2 or 8* wherein the sheet is pinned to the busbar by a rivet.

6. The method of [1] *2 or 8* wherein the sheet is pinned to the busbar by a pin.

*8. The method of claim 1, further comprising soldering the busbar and the sheet together in the joint before pinning the busbar to the sheet, wherein pinning the busbar to the sheet comprises pinning the busbar to the sheet through the soldered joint.*

*9. The method of claim 8, wherein the pin is positioned to support a portion of shear stress applied to the soldered joint between the busbar and the sheet.*

*10. The electrowinning anode of claim 7, wherein the busbar and the sheet are soldered together in the joint, and wherein the pin is located through the soldered joint between the busbar and the sheet.*

*11. The electrowinning anode of claim 10, wherein the pin is positioned to support a portion of shear stress applied to the soldered joint between the busbar and the sheet.*

*12. An electrowinning anode made in accordance with the method of claim 2 or 8.*

*13. A method of making an electrowinning anode comprising:*

*forming a sheet of lead alloy anode material;*

*forming a copper busbar with a longitudinal slot of such size that an end of the lead alloy sheet fits tightly therein;*

*fitting said end of the lead sheet into said slot of the busbar to form a joint;*

*soldering the busbar and sheet together in the joint to form a soldered joint;*

*pinning the busbar to the sheet with a pin through the soldered joint;*

*immersing the pinned busbar and the soldered joint into a lead electroplating bath; and*

*electrodepositing a coating of lead onto the busbar, pin, and soldered joint whereby a metallurgical seal is formed around the busbar, pin and soldered joint.*

*14. The method of claim 13, wherein the pin is positioned to support a portion of shear stress applied to the soldered joint between the busbar and the sheet.*

*15. An electrowinning anode made in accordance with the method of claim 13.*

*16. An electrowinning anode comprising:*

*a sheet of lead alloy material;*

*a copper busbar having a longitudinal slot into which the sheet is tightly fitted to form a joint, wherein the sheet and the busbar are soldered together in the joint to form a soldered joint;*

*a pin through the soldered joint between the copper busbar and the sheet; and*

*an electrodeposited coating of lead forming a metallurgical seal around the pin, the busbar, and the soldered joint between the sheet and the busbar;*

*wherein the pin is positioned to support a portion of shear stress applied to the soldered joint between the busbar and the sheet.*

* * * * *